US007869726B2

(12) United States Patent
Sato

(10) Patent No.: US 7,869,726 B2
(45) Date of Patent: Jan. 11, 2011

(54) IMAGE FORMING APPARATUS

(75) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 155 days.

(21) Appl. No.: 12/020,829

(22) Filed: Jan. 28, 2008

(65) Prior Publication Data

US 2008/0181652 A1 Jul. 31, 2008

(30) Foreign Application Priority Data

Jan. 29, 2007 (JP) ..... 2007-017526

(51) Int. Cl.
*G03G 15/00* (2006.01)
*G03G 15/08* (2006.01)
*G03G 15/06* (2006.01)

(52) U.S. Cl. ..... 399/55; 399/44; 399/46; 399/53; 399/83

(58) Field of Classification Search ..... 399/27, 399/46, 50, 53, 55, 88
See application file for complete search history.

(56) References Cited

U.S. PATENT DOCUMENTS 5,365,318 A * 11/1994 Hiraoka et al. ..... 399/44
5,436,697 A * 7/1995 Negishi ..... 399/46
5,473,417 A * 12/1995 Hirano ..... 399/285
5,822,657 A * 10/1998 Hisada et al. ..... 399/149
5,826,138 A * 10/1998 Tsuru et al. ..... 399/55
5,978,635 A * 11/1999 Azuma et al. ..... 399/283
6,650,850 B2 * 11/2003 Nishimura ..... 399/50
6,766,121 B2 * 7/2004 Nonaka et al. ..... 399/24
7,515,840 B2 * 4/2009 Yamane ..... 399/44
2005/0226659 A1 * 10/2005 Ebe ..... 399/286
2005/0260007 A1 * 11/2005 Shimomura ..... 399/55
2006/0127133 A1 * 6/2006 Suzuki ..... 399/167

FOREIGN PATENT DOCUMENTS

JP 04-324469 11/1992
JP 09171286 A * 6/1997
JP 10-111603 4/1998
JP 11305501 A * 11/1999
JP 2005-031355 2/2005

* cited by examiner

*Primary Examiner*—David M Gray
*Assistant Examiner*—Francis Gray
(74) *Attorney, Agent, or Firm*—Rabin & Berdo, PC

(57) ABSTRACT

An image forming apparatus performs prints image data. A dividing section divides the image data of a print job into a plurality of sub data areas m(i) (i=1 to n). A duty computing section computes a print duty for each of the plurality of sub data areas (m(1)-m(n)) based on the number of printed dots in the print job and a total number of printable dots in a printable area. A first power supply applies a first voltage to a developing roller. A second power supply applies a second voltage to the developer supplying roller. The voltage difference between the first and second voltages is determined in accordance with the print duty.

13 Claims, 12 Drawing Sheets

IMAGE FORMING APPARATUS

BACKGROUND OF THE INVENTION

1. Field of the Invention

The present invention relates to an image forming apparatus such as printers and copying machines based on electrophotography.

2. Description of the Related Art

An electrophotographic image forming apparatus involves charging, developing, transferring, and fixing processes. A charging unit charges the surface of a photoconductive drum uniformly. An exposing unit illuminates the charged surface of the photoconductive drum in accordance with image data to form an electrostatic latent image. A developing unit supplies toner to the electrostatic latent image to develop the electrostatic latent image into a toner image. The toner image is then transferred onto a print medium such as print paper. Then, the print medium advances to a fixing unit where the toner image is fused into a permanent image. After fixing, the print medium is discharged onto a stacker.

A developing roller held in the developing unit includes a resilient layer of semi-conductive urethane rubber. The surface of the urethane rubber is formed by dipping the developing roller in a chemical solution or by coating with a chemical solution. Subsequently, the developing roller is heated to increase the ability to be triboelectrically charged, decrease the friction coefficient of the developing roller in contact with a toner supplying roller, and prevent contamination of the photoconductive drum.

An image pattern is often printed which has a partially high print duty such as a ruled pattern extending in a sub-scanning direction perpendicular to a direction of travel of the print medium. Continuous printing of such an image pattern causes the areas on the surface layer of the developing roller subjected to the high print duty to wear out. The wear of the developing roller causes the diameter of the developing roller to decrease, thereby decreasing a nip formed between the developing roller and the photoconductive drum. This leads to partially vague images or deposition of toner charges to an unwanted polarity.

SUMMARY OF THE INVENTION

The present invention was made in view of the aforementioned problems.

An object of the invention is to provide an image forming apparatus in which when continuous printing is performed to print an image having a pattern of a partially high print duty, wear-out of a developing roller is minimized and printed images are not vague.

An image forming apparatus performs printing based on image data received from a host apparatus. An electrostatic latent image is formed on an image bearing body. A developer material bearing body supplies a developer material to the electrostatic latent image to form a developer image. A developer supplying member supplies the developer material to the developer material bearing body. A first power supply applies a first voltage to the developer material bearing body. A second power supply applies a second voltage (V2) to the developer material supplying member. A computing section computes a print duty for each of the plurality of sub data areas based on the number of dots and the number of rotations. A memory holds a reference and the print duty. A comparing section compares the print duty with the reference. A controller controls at least one of the first power supply and the second power supply to increase a voltage difference between the first voltage and the second voltage, the voltage difference being increased when the print duty is larger than the reference. The dividing section divides image data of a print job into a plurality of sub data areas. A duty computing section computes a print duty for each of the plurality of sub data areas based on the number of printed dots in the print job and a total number of printable dots in a printable area.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
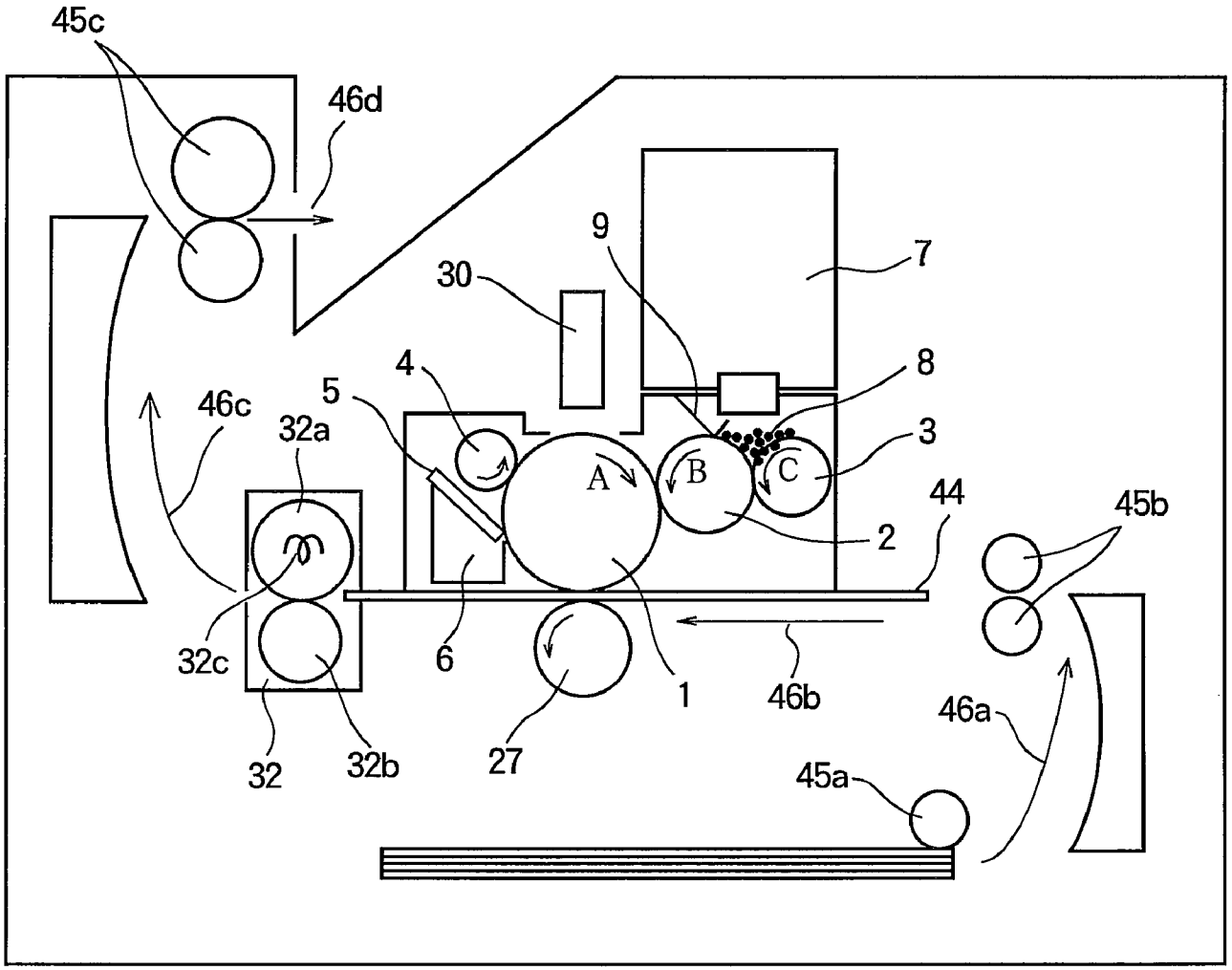
FIG. 1 illustrates the general configuration of an image forming apparatus of a first embodiment.

FIG. 1 illustrates the general configuration of an image forming apparatus of a first embodiment.

Referring to FIG. 1, the image forming apparatus includes at least one developing unit that receives toner 8 from a toner cartridge 7 and holds the toner 8 therein. A photoconductive drum 1 is in the shape of a drum, and is covered with a photoconductive layer. The photoconductive drum 1 parallels with a developing roller 2 and a charging roller 4, and rotates in a direction shown by arrow A in contact with the developing roller 2 and the charging roller 4. The charging roller 4 charges the surface of the photoconductive drum 1 uniformly. An LED head 30 is an optical head incorporating light emitting diodes (LEDs) therein, and illuminates the charged surface of the photoconductive drum 1 to form an electrostatic latent image. The developing roller 2 supplies the toner 8 to the photoconductive drum 1 to develop the electrostatic latent image into a toner image.

The developing roller 2 rotates in a direction shown by arrow B. A thin layer 70 (FIG. 10) of the toner 8 is formed on the circumferential surface of the developing roller 2. As the developing roller 2 rotates, the toner 8 is supplied to the electrostatic latent image formed on the photoconductive drum 1. A toner supplying roller 3 parallels with the developing roller 2, and rotates in contact with the developing roller 2. When the toner supplying roller 3 rotates in a direction shown by arrow C, it supplies the toner 8 to the developing roller 2.

A cleaning blade 5 is a longitudinally extending blade-like member, and includes one of two long edges in contact with the photoconductive drum 1. The cleaning blade 5 scrapes the residual toner from the photoconductive drum 1 after transferring the toner image onto a print medium 44. A waste toner reservoir 6 holds the residual toner scraped off the photoconductive drum 1.

The toner cartridge 7 holds the toner 8 therein. The toner 8 is a developing material in the form of a powder that develops an electrostatic latent image formed on the photoconductive drum 1. A developing blade 9 is a longitudinally extending blade-like member. The developing blade 9 is in pressure contact with the developing roller 2 to form the thin layer 70 of the toner 8 on the developing roller 2 as the developing roller 2 rotates. A transfer roller 27 parallels with the photoconductive drum 1 to define a transfer point between the photoconductive drum 1 and the transfer roller 27. A transfer voltage is applied across the photoconductive drum 1 and the transfer roller 27. As the print medium 44 is pulled into the transfer point, the toner image is transferred from the photoconductive drum 1 onto the print medium 44 by the Coulomb force.

The LED head 30 includes a plurality of LEDs that are energized in accordance with image data to form an electrostatic latent image on the photoconductive drum 1. A fixing unit 32 includes a heat roller 32*a*, a pressure roller 32*b*, a heater 32*c* incorporated in the heat roller 32*a*, and a temperature sensor (not shown) that detects the surface temperature of the heat roller 32*a*. The print medium 44 is of, for example, A4 size paper onto which the toner image is transferred from the photoconductive drum 1. A hopping roller 45*a* feeds the print medium on a page-by-page basis toward transport rollers 45*b*. The hopping roller 45*a* and transport rollers 45*b* are driven in rotation by a motor 34. The print medium 44 is transported in a direction shown by arrows 46*a*, 46*b*, and 46*c*.

Figure 2:
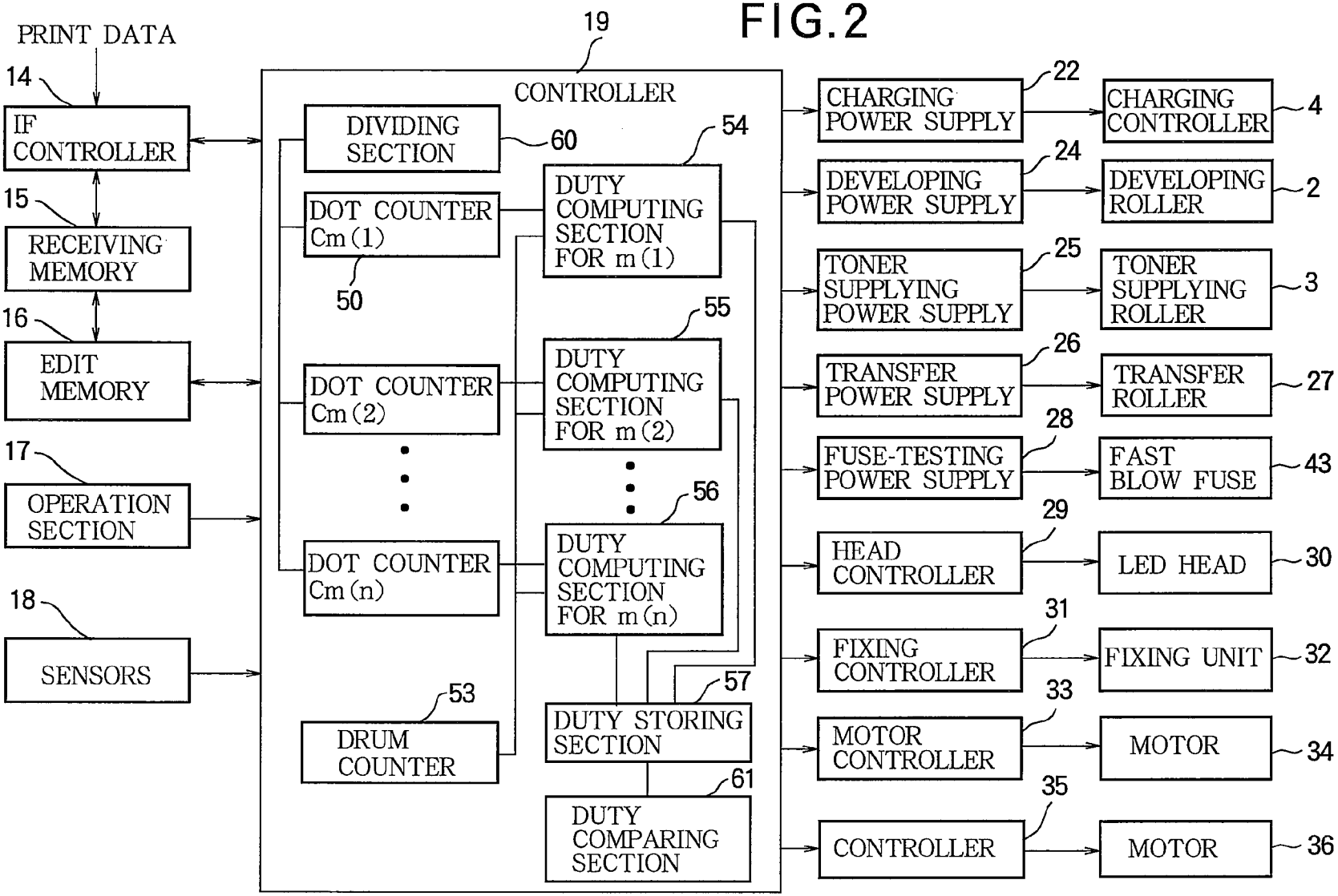
FIG. 2 is a block diagram illustrating the general configuration of the image forming apparatus.

FIG. 2 is a block diagram illustrating the general configuration of the image forming apparatus. Referring to FIG. 2, an interface (I/F) controller 14 receives image data and control commands from a host apparatus (not shown). A receiving memory 15 temporarily holds the image data received through the interface controller 14. An edit memory 16 receives the image data from the receiving memory 15, and holds image data obtained by editing the image data. An operation section 17 includes switches via which a user inputs commands, LEDs, and a display on which status conditions of the image forming apparatus are displayed to the user. Sensors 18 include various sensors for monitoring the status conditions of the overall operations of the image forming apparatus. The sensors include paper position sensors, temperature sensors, a humidity sensor, and a density sensor. A controller 19 includes a microprocessor, a ROM, a RAM, an I/O port, and a timer. The controller 19 receives image data and control commands from a host apparatus via the interface controller 14, thereby controlling the overall sequence of the image forming apparatus during printing.

The charging power supply 22 outputs a charging voltage V4 to the charging roller 4 under the control of the controller 19, thereby charging the surface of the photoconductive drum 1. A developing power supply 24 outputs a developing voltage V1 (approximately −300 V) to the developing roller 2 under the control of the controller 19, thereby charging the developing roller 2. A toner supplying power supply 25 outputs a supplying roller voltage V2 to the toner supplying roller 3 under the control of the controller 19. The supplying roller voltage V2 (approximately −450 V) causes the toner 8 to be deposited on the toner supplying roller 3, which in turn supplies the toner 8 to the developing roller 2. A transfer power supply 26 outputs a transfer voltage to the transfer roller 27 for transferring the toner image from the photoconductive drum 1 onto the print medium 44.

A fuse-testing power supply 28 causes current to flow through a fast-blow fuse 43, thereby determining whether a developing unit is a new, unused unit. A head controller 29 sends the image data held in the edit memory 16 to the LED head 30, thereby driving the LED head 30. A fixing controller 31 reads the output of the temperature sensor (not shown) for the fixing unit 32, and supplies electric power to the heater 32*c* in accordance with the output of the temperature sensor such that the heat roller 32*a* is maintained at a predetermined temperature. The fixing unit 32 fuses the toner image transferred onto the print medium 44 under the control of the fixing controller 31.

A motor controller 33 controls the motor 34 under the control of the controller 19 to transport and stop the print medium 44 at proper timings. When a motor 36 (FIG. 2) rotates under the control of a controller 35, the photoconductive drum 1 (FIG. 1), charging roller 4, developing roller 2, and toner supplying roller 3 rotate in the respective directions.

Figure 3:
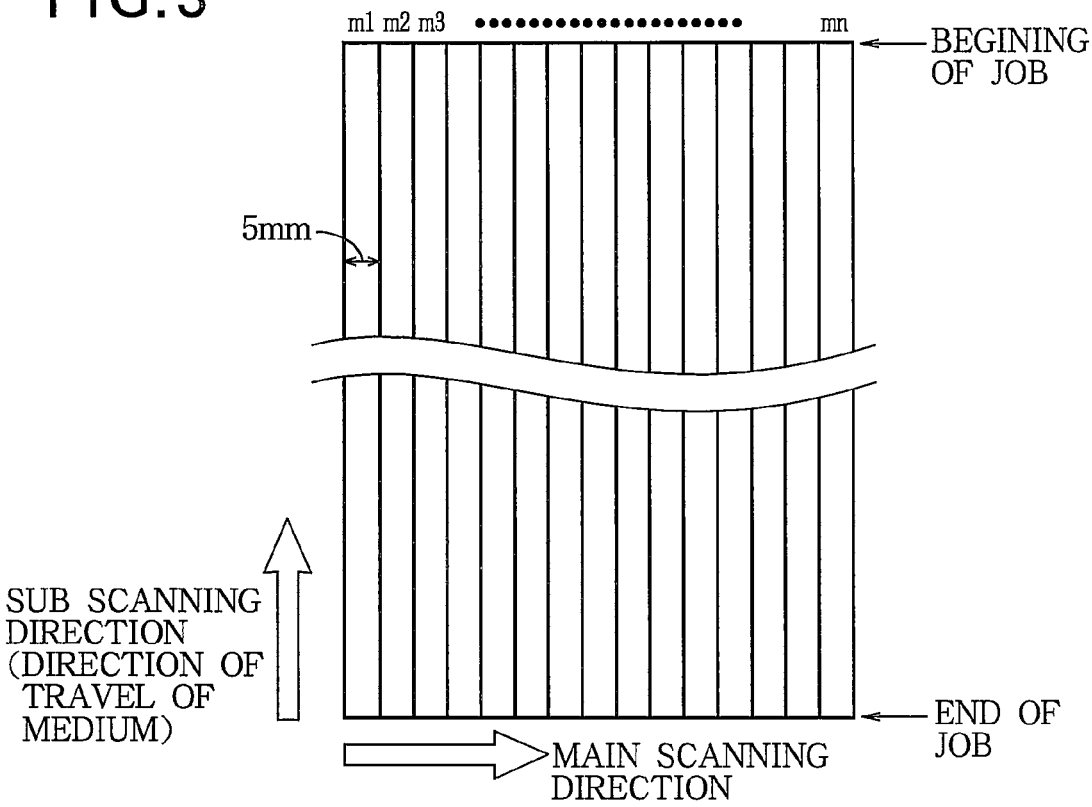
FIG. 3 illustrates sub data areas of image data printed on the print medium.

FIG. 3 illustrates sub data areas of image data printed on the print medium 44, the sub data areas being held in the edit memory 16. Referring to FIG. 3, the data area (printable area) of a print job is divided into n sub data areas m(1), m(2), m(3), . . . , m(i), . . . , m(n) (n is an integer) such that each one of the sub data areas m(1) to m(n) is, for example, 5 mm wide in the main scanning direction perpendicular to a direction of travel of the print medium 44.

Referring back to FIG. 2, a dot counter Cm(1) counts the number of printed dots in the sub data area m(1). Likewise, dot counters Cm(2), Cm(3), . . . , Cm(i), . . . , Cm(n) count the number of printed dots in the sub data areas m(2), m(3), . . . , m(i), . . . , m(n), respectively. A drum counter 53 counts the number of rotations of the photoconductive drum 1 during the printing operation of the print job.

The term "print duty" as used here refers to the ratio of a printed area to a total printable area. For the sake of convenience, the "print duty" in this specification is measured in terms of the number of printed dots in each sub image data area m(i) for a print job, a total number of printable dots per one complete rotation of the photoconductive drum 1, and a total number of rotations of the photoconductive drum 1 during the printing operation of the print job. A duty computing section 54 computes the print duty of sub data in the i-th sub data area m(i) as follows:

$$d(i) = \frac{Cm(i)}{C0 \times Cd} \quad \text{Eq. 1}$$

where d(i) is the print duty for i-th sub data area m(i), Cm(i) is the count of the dot counter for the i-th sub data area m(i), C0 is a total number of printable dots per one complete rotation of the photoconductive drum 1, and Cd is the count of the drum counter 53.

Likewise, the duty computing sections 55 to 56 compute the print duties for corresponding ones of sub data areas m(2) to m(n). The drum counter 53 counts the number of rotations of the photoconductive drum 1 during the printing operation of the print job. A duty storing section 57 stores a predetermined threshold value Dth (e.g., 40%) of print duty, a cumulative print duty $$\sum_{J=1}^{J=J} d(i)$$

for the sub data area m(i) (i=1 to n) (i.e., a sum of print duties for m(i) of all the print jobs that were printed in the past), the cumulative number of print duties J for the sub data area m(i) (i=1 to n), and an average value Ad(i) (i=1 to n) of the cumulative print duty $$\sum_{J=1}^{J=J} d(i)$$

for the sub data area m(i) to m(n). The average value of cumulative print duty is a value obtained by dividing the cumulative print duty $$\sum_{J=1}^{J=J} d(i)$$

by the cumulative number of print duties J. The average value of cumulative print duty is computed for each one of the sub data areas m(1), m(2), . . . , m(i), . . . , m(n). The cumulative number of print duties J is equal to a total number of jobs that were printed in the past.

Referring back to FIG. 3, a diving section 60 divides the printed image data into n sub data areas, i.e., m(1), m(2), m(3), . . . , m(i), . . . , m(n). The duty comparing section 61 compares the average value Ad(i) of each of cumulative print duties $$\sum_{J=1}^{J=J} d(1),\quad \sum_{J=1}^{J=J} d(2),\quad \sum_{J=1}^{J=J} d(3), \ldots,\quad \sum_{J=1}^{J=J} d(i), \ldots,\quad \sum_{J=1}^{J=J} d(n)$$

held in the duty storing section 57 with the threshold value Dth. For example, the average value A(d(i) of the i-th cumulative print duty $$\sum_{J=1}^{J=J} d(i)$$

is computed as follows:

$$Ad(i) = \frac{\sum_{J=1}^{J=J} d(i)}{J}$$

where $$\sum_{J=1}^{J=J} d(i)$$

is a cumulative print duty for sub data area m(i), J is the total number of print jobs, and Ad(i) is the average value of the cumulative print duty for sub data area m(i).

The general operation of the image forming apparatus (FIG. 2) and the developing unit (FIG. 3) will be described. The controller 19 receives control commands via the I/F controller 14, and image data from the edit memory 16. Then, the controller 19 controls the overall sequence of the image forming apparatus to perform printing.

Upon receiving the control commands, the controller 19 outputs a signal for driving the motor controller 33 to transport the print medium 44. The motor controller 33 supplies electric power to the motor 34, which in turn drives the transport rollers 45*a*-45*c* to transport the print medium 44 at appropriate timings. The print medium 44 is fed into the transport path by the feed roller 45*a*. The print medium 44 advances through the transport roller 45*b* in the direction shown by arrow 46*b*.

The controller 19 outputs a drive signal to the controller 35, which in turn supplies electric power to the motor 36. Then, the motor 36 drives the photoconductive drum 1 in rotation.

The charging roller 4 rolls on the surface of the rotating photoconductive drum 1. Upon receiving a command from the controller 19, the charging power supply 22 applies the voltage V4 to the charging roller 4, which in turn charges the surface of the photoconductive drum 1. The LED head 30 illuminates the charged surface of the photoconductive drum 1 in accordance with image data under the control of the head controller 29, thereby forming an electrostatic latent image on the photoconductive drum 1.

The toner supplying roller 3 supplies the toner 8 to the developing roller 2. Under the control of the controller 19, the developing power supply 24 applies the developing voltage V1 to the developing roller 2 while the toner supplying power supply 25 applies the supplying roller voltage V2 to the toner supplying roller 3, thereby creating an electric field across the developing roller 2 and the toner supplying roller 3. Thus, the toner 8 is attracted to the developing roller 2 by the Coulomb force. As the developing roller 2 rotates, the toner 8 on the developing roller 2 passes under the developing blade 9, which forms the thin layer 70 of the toner 8 on the developing roller 2.

As the developing roller 2 further rotates, the thin layer 70 of the toner 8 is brought into contact with the electrostatic latent image formed on the photoconductive drum 1, thereby developing the electrostatic latent image into the toner image. As the developing roller 2 further rotates, the toner image is transferred onto the print medium 44 by the Coulomb force and physical pressure.

The print medium 44 having the toner image thereon passes through a fixing point defined between the heat roller 32*a* and the pressure roller 32*b* of the fixing unit 32. Thus, the toner image on the print medium 44 is fused into a permanent image by the pressure and heat. The print medium 44 is then transported in the direction shown by arrow 46*c* to the transport roller 45*c*, and is finally discharged onto the stacker.

A detailed description will be given of problems of a conventional image forming apparatus and a developing unit.

The fresh, unused toner that has just been supplied from a toner cartridge contains a resin, carbon black, and a softening agent. The particles are mixed with silica, a titanium oxide, or an abrasive powder, all acting as an external additive. When continuous printing is performed for high duty images such as solid images, the fresh toner 8 is supplied preferentially to the portion of the photoconductive drum 1 at which the high duty images are formed. Likewise, the fresh toner 8 is supplied preferentially to the portion of the developing roller 2 that is brought into contact with the high duty image portion on the photoconductive drum 1. Thus, the areas of the developing roller 2 that contact electrostatic latent images tend to have a high duty more frequently than the other areas of the developing roller 2. This implies that the surface of the developing roller 2 is ground by the external additive of the toner 8 such as an abrasive powder. As a result, wear of the developing roller may cause a vague image to appear in solid images or may cause soiling of the print medium.

Figure 4:
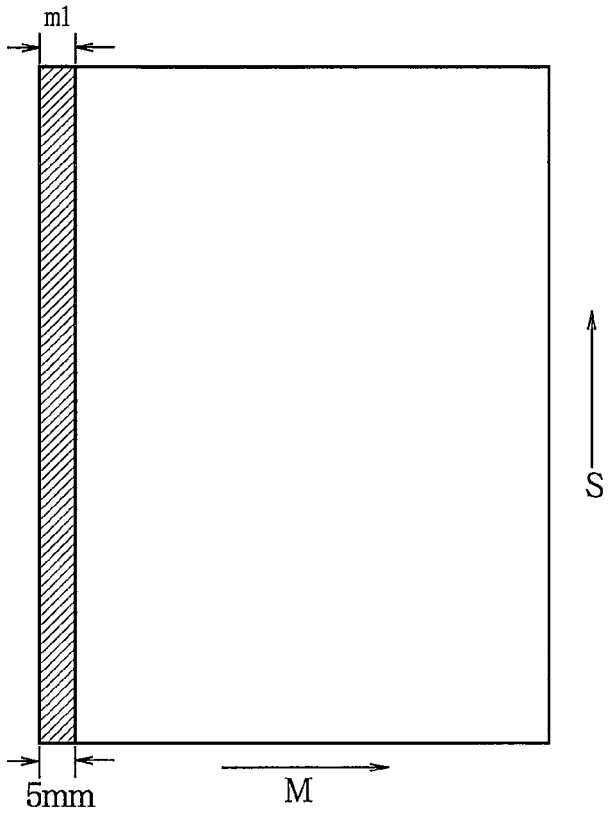
FIG. 4 illustrates an example of image data containing a portion of a high print duty.

In order to prevent or minimize wear of the surface of the photoconductive drum 1 during high-duty printing, it is necessary to distinguish high-duty printing from low-duty printing prior to a printing operation, and appropriate measures should be taken. A known method for determining whether image data has a high print duty portion is to calculate a print duty in terms of the number of printed dots per one complete rotation of the photoconductive drum 1 to print the dots. However, this conventional method suffers from a drawback in that a computed print duty may be low if the image data contains only a limited portion of high print duty. An example will be described as follows:

FIG. 4 illustrates an example of image data containing a portion of a high print duty indicated by hatching. The print duty portion having a high print duty is a belt-shaped pattern, having a 5-mm width and a print duty of 100% (i.e., solid image) and extending in a direction perpendicular to the main scanning direction. If continuous printing is performed to print this belt-shaped pattern, the portion of a partial high print duty is repeatedly printed.

The print medium 44 advances in a direction shown by arrow S while the pattern has a narrow width extending in a direction shown by arrow M. Because the pattern shown in FIG. 4 occupies only a small area in the M direction, an apparent print duty calculated by using Eq. 1 appears to be low. This makes it difficult to properly determine whether image data is of high print duty, causing a vague image to appear in a solid image portion as well as resulting in soiling of the print medium 44.

In the present embodiment, the image data is divided into n sub data areas m(1), m(2), m(3), . . . , m(i), . . . , m(n), each of which is 5 mm in width. Then, print duty is calculated for each sub data area by using Eq. (1). An average value Ad(i) of print duty for the sub data area m(i) is an average of the cumulative print duty $$\sum_{J=1}^{J=J} d(i)$$

for the sub data area m(i), and is computed based on all of the print jobs printed in the past.

The dot counters Cm(1), Cm(2), . . . , Cm(i), . . . , Cm(n) outputs their counts to the corresponding duty computing sections 54 to 56. The drum counter 53 also outputs its count to the duty computing sections 54 to 56.

The duty computing sections 54 to 56 compute print duties for the respective sub data areas based on the counts from the dot counters Cm(1), Cm(2), . . . , Cm(i), . . . , Cm(n) and the count from the drum counter 53, and then send the computed print duties for the respective sub data areas m(1), m(2), m(3), . . . , m(i), . . . , m(n) to the duty storing section 57. The print duties are added to the corresponding accumulated values stored in the duty storing section 57. Then, the duty storing section 57 computes an average value for each sub data area based on accumulated values of print duty.

Figure 5:
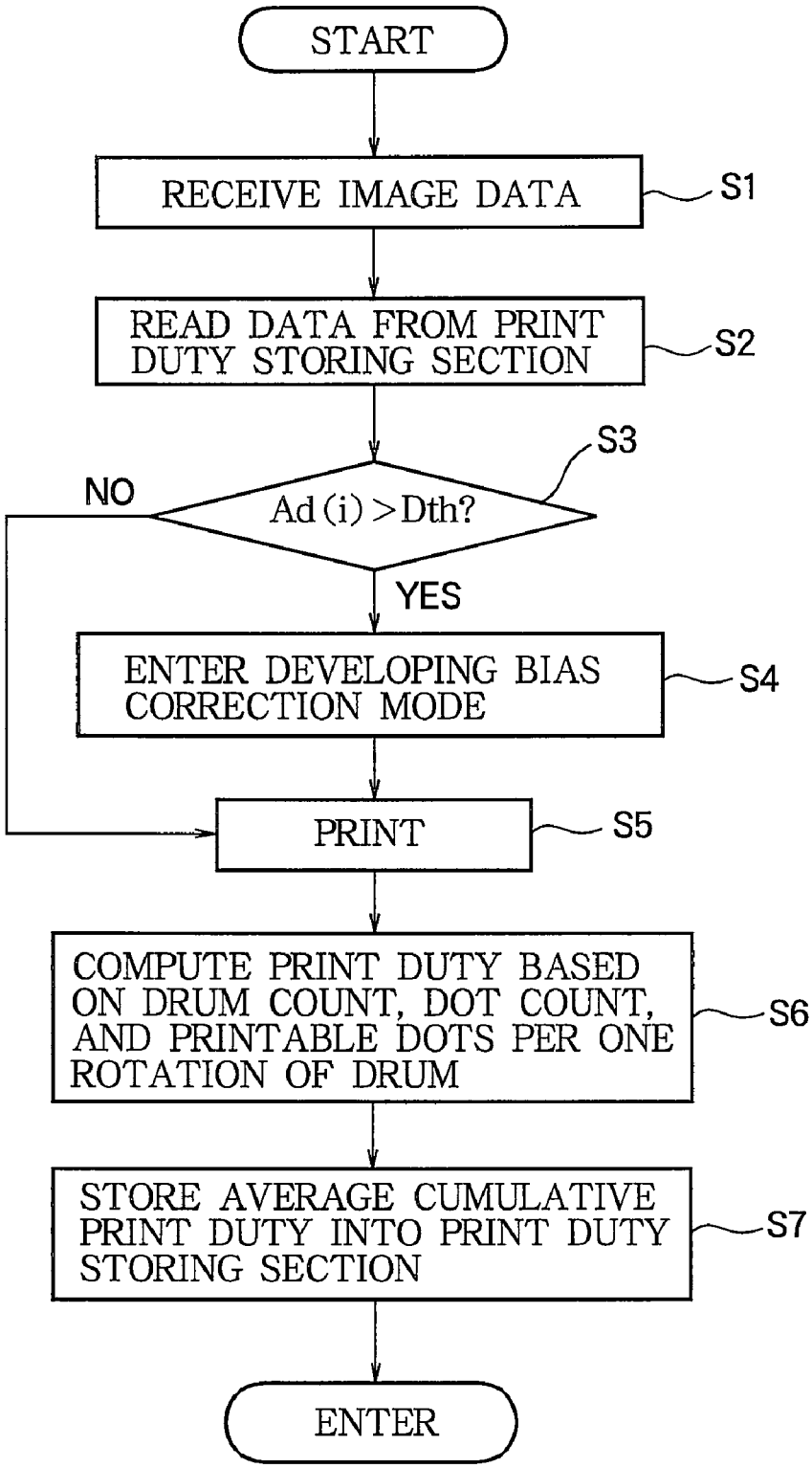
FIG. 5 is a flowchart illustrating how image data containing a high print duty portion is detected.

A method for determining whether image data contains a partially high print duty portion will be described. FIG. 5 is a flowchart illustrating how image data containing a partially high print duty portion is detected.

At step S1, the receiving memory 15 temporarily holds the image data received through the interface controller 14.

At step S2, the duty comparing section 61 reads the average value Ad(i) from the duty storing section 57.

At step S3, the duty comparing section 61 compares the average value Ad(i) with the threshold value Dth to determine whether the average print duty Ad(i) is greater than the threshold value Dth (e.g., 40%).

If all of the average values Ad(1), Ad(2), Ad(3), . . . Ad(i), . . . , Ad(n) are smaller than the threshold value Dth (NO at step S3), the program proceeds to step S5. If any one of the average values Ad(1), Ad(2), Ad(3), . . . Ad(i), . . . , Ad(n) is larger than the threshold value Dth (YES at step S3), the program proceeds to step S4.

At step S4, the image forming apparatus enters a developing bias correction mode.

At step S5, printing is performed.

At step S6, the duty computing section 54 computes the print duties for the respective sub data areas m(1), m(2), m(3), . . . , m(i) . . . , m(n) based on the number of printed dots (i.e., counts of counters Cm(1), Cm(2), Cm(3), . . . , Cm(i) . . . , Cm(n), a total number of printable dots per one complete rotation of the image bearing body (1), and the count of the drum counter 54.

At step S7, a new average value Ad(i) of the print duty for each of the sub data areas is computed based on the print duty of the image data printed at step S5 and the cumulative print duties $$\sum_{J=1}^{J=J} d(1),\quad \sum_{J=1}^{J=J} d(2),\quad \sum_{J=1}^{J=J} d(3), \ldots,\quad \sum_{J=1}^{J=J} d(i), \ldots,\quad \sum_{J=1}^{J=J} d(n),$$

and is then stored into the duty storing section 57.

Then, printing completes.

Figure 6:
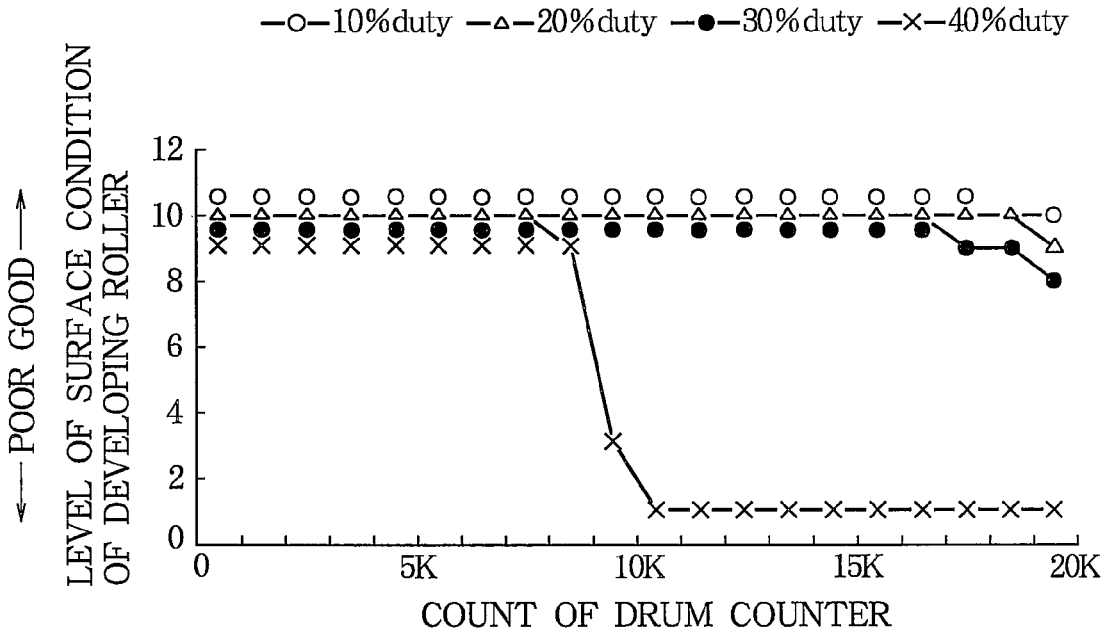
FIG. 6 illustrates the relationship between the count of the photoconductive drum and the levels of surface condition of the developing roller.

FIG. 6 illustrates the relationship between the count of the drum counter 53 and the levels of surface condition of the developing roller 2. The lower the value of surface condition is, the more the developer roller 2 is worn out. The threshold value Dth is determined from the relation shown in FIG. 6.

Continuous printing is performed for different print duties (i.e., by varying the number of printed dots in the ruled pattern) of the ruled pattern (e.g., 5-mm wide) shown in FIG. 4, thereby investigating the levels of wear of the developing roller 2. For print duties less than 40%, the surface condition is LEVEL "8" or higher for the counts of the drum counter 53 of up to 20K. For a print duty of 40%, the surface condition falls to LEVEL "1" at the count of the drum counter 53 of 10K. A surface condition of LEVEL "1" indicates that the surface layer of the developing roller 2 has been very worn out and therefore the surface layer is unable to function properly. Further, a surface condition of LEVEL "1" decreases the amount of nip between the photoconductive drum 1 and the developing roller 2, causing vague images to appear in solid images as well as resulting in soiling of the print medium 44. Therefore, the threshold value Dth of print duty is selected to be 40%.

{Developing Bias Correction Mode}

The developing bias correction mode at step S4 of FIG. 5 will be described. The developing bias correction mode is an operation mode in which the voltage difference V3 between the developing voltage V1 supplied to the developing roller 2 and the supplying roller voltage V2 supplied to the toner supplying roller 3 is varied to adjust the thickness of the thin layer of toner formed on the developing roller 2.

The developing power supply 24 outputs the developing voltage V1 to the developing roller 2, and the toner supplying power supply 25 outputs the supplying roller voltage V2 to the toner supplying roller 3. These two voltages are of the same polarity, and are related such that $|V1| \leqq |V2|$.

There is the following correlation between the amount of the toner 8 deposited on the developing roller 2 and the voltage difference |V3| between |V1| and |V2|.

$$h = A \times |V3| + B \qquad \text{Eq. 2}$$

where h is the amount ($mg/cm^2$) of toner deposited on the developing roller 2, A is a constant ($mg/cm^2 \cdot V$) per unit value of |V3|, and B is a constant ($mg/cm^2$). The constants A and B vary depending on ambient temperature and humidity.

Figure 7:
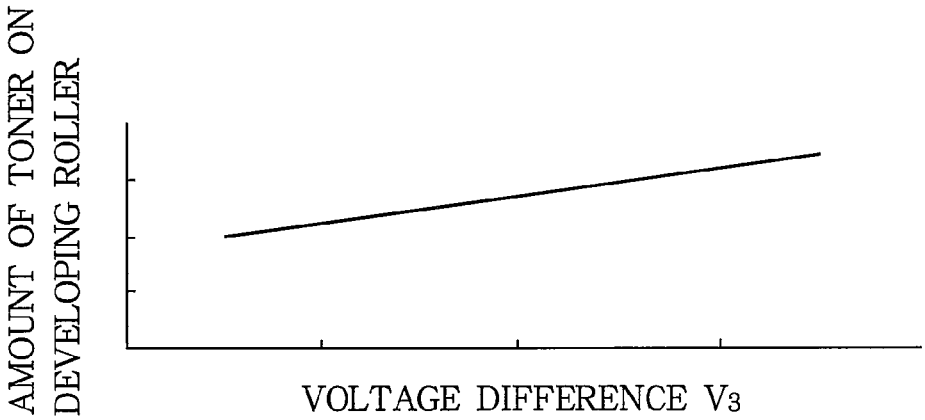
FIG. 7 illustrates the relation between the voltage difference |V3| and the changes in the amount of toner deposited on the developing roller.
Figure 8:
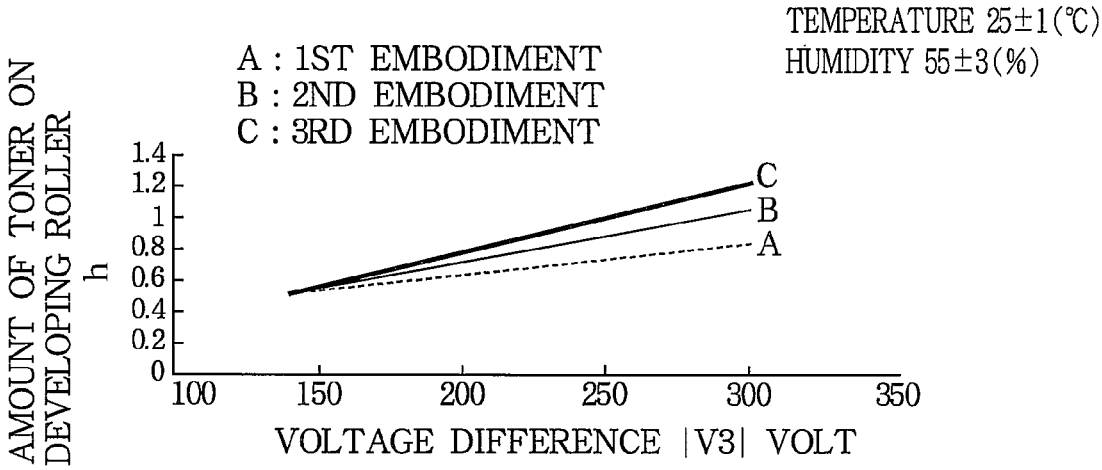
FIG. 8 illustrates relations between the voltage difference |V3| and the changes in the amount of toner deposited on the developing roller for respective embodiments.

FIG. 7 illustrates the relation between the voltage difference |V3| and the changes in the amount of toner deposited on the developing roller 2. FIG. 8 illustrates the relation between the voltage difference |V3| and the change in the amount of toner deposited on the developing roller 2 for the respective embodiments. Curve A illustrates the first embodiment.

Table 1 lists the various power supply voltages and constants A and B when the image forming apparatus operates in the developing bias correction mode.

TABLE 1

| Voltages and constants | With no correction | With correction |
|---|---|---|
| V1 (volts) | −300 | −240 |
| V2 (volts) | −450 | −450 |
| V3 (volts) | −150 | −210 |
| V4 (volts) | −1350 | −1350 |
| V5 (volts) | −1050 | −1110 |

TABLE 1-continued

| Voltages and constants | With no correction | With correction |
|---|---|---|
| A | | 0.0020 |
| B | | 0.250 |

$|V5| = |V4| - |V1|$,
$|V3| = |V2| - |V1|$,
$150 \leqq |V3| \leqq 300$

Figure 9:
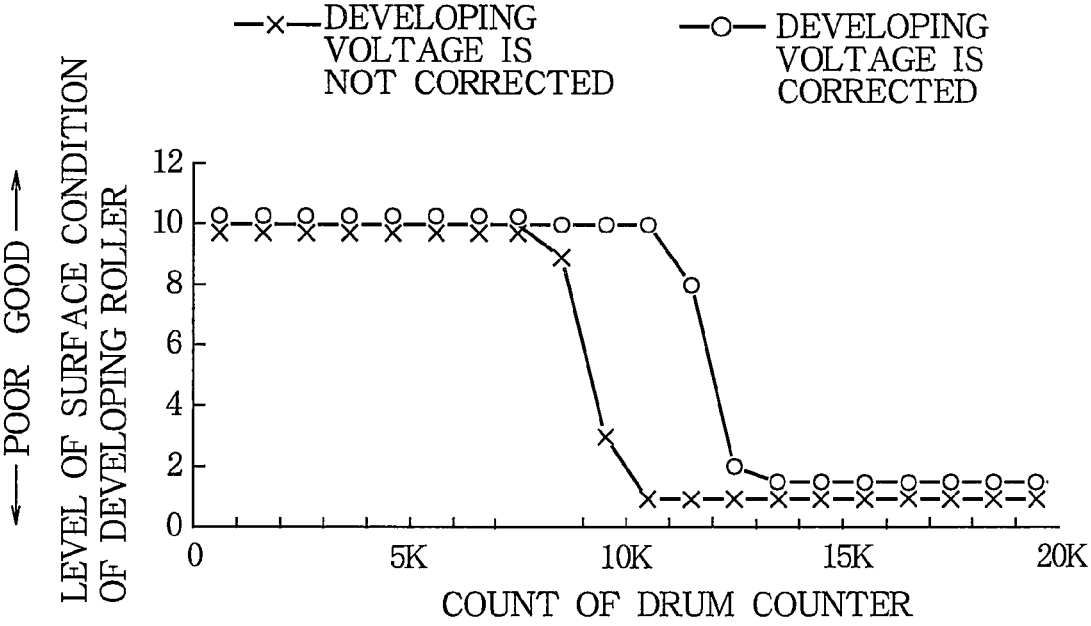
FIG. 9 illustrates an example of the relation between the level of wear of the developing roller and the count of the drum counter.

FIG. 9 illustrates an example of the relation between the level of wear of the developing roller 2 and the count of the drum counter 53 (FIG. 2) when the image forming apparatus operates in the developing bias correction mode and when the image forming apparatus does not operate in the developing bias correction mode.

Continuous printing is performed to print a 5-mm width ruled pattern (FIG. 4) having a print duty of 100%.

The lower the value of surface condition of the developer roller 2 is, the more the developer roller 2 is worn out. The lifetime of the developing roller 2 may be longer by a factor of approximately 1.4 when the image forming apparatus operates in the developing bias correction mode than when the image forming apparatus does not operate in the developing bias correction mode.

Figure 10:
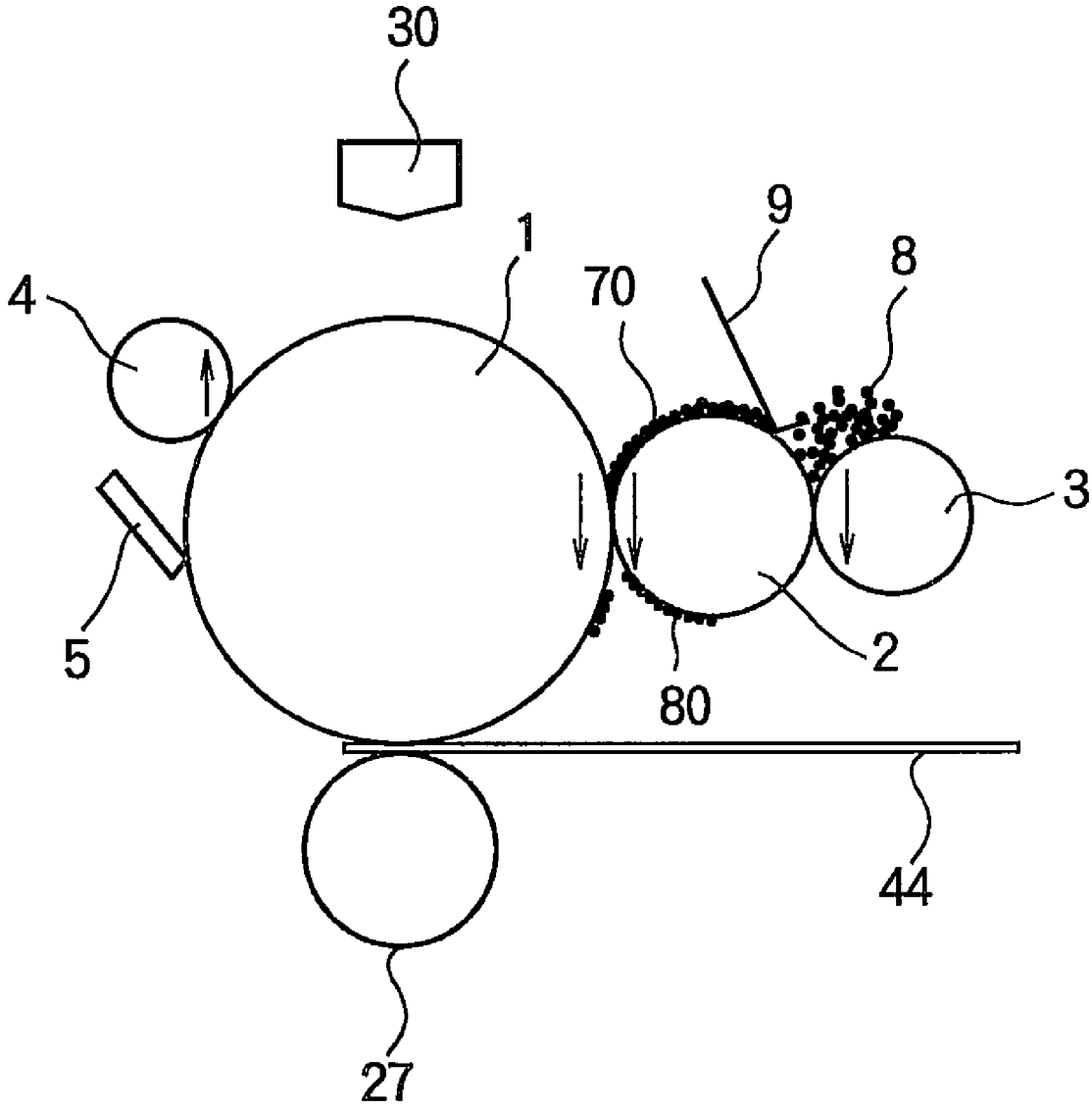
FIG. 10 illustrates the toner remaining on the developing roller after development of an electrostatic latent image formed on the photoconductive drum.

FIG. 10 illustrates the toner 80 remaining on the developing roller 2 after development of an electrostatic latent image formed on the photoconductive drum 1.

As is clear from Eq. (2) and FIG. 7, smaller values of voltage difference |V3| cause smaller amounts of toner deposited on the developing roller 2. Larger values of voltage difference |V3| cause larger amounts of toner deposited on the developing roller 2.

As is clear from FIG. 8 and Table 1, decreasing the developing voltage |V1| from |−300| V to |−240| V causes the voltage difference |V3| to increase from 150 V to 210 V. As a result, the amount of toner h deposited on the developing roller 2 increases from 0.55 $mg/cm^2$ to 0.67 $mg/cm^2$ as shown in FIG. 8. In the present embodiment, the constants A and B are assumed to be 0.0020 and 0.250, respectively, and the temperature is 25±1° C. and the humidity is 55±3%.

An increase in the voltage difference |V3| in the developing bias correction mode increases the amount of deposited toner as shown in FIGS. 7 and 8, thus increasing the thickness of the thin layer 70. Thus, the toner that is not used for developing an electrostatic latent image remains deposited on the developer roller 2 after the development of the electrostatic latent image.

The toner 80 functions as a surface protective layer that prevents the fresh toner 8 from rubbing or scratching the surface of the developing roller 2 when the developing roller receives the fresh toner 8 from the toner supplying roller 3.

As described above, the received image data is divided into a plurality of sub image data areas in the main scanning direction. After printing, printed dots in each sub image data area are counted and a print duty in a corresponding sub image data area is computed. Prior to the printing of a current print job, the print duty of each sub image data area up to the immediately preceding print job is compared with a threshold value. Based on the comparison result, a decision is made to determine whether image data of the following print job has a partially high print duty, and then the developing bias is changed in the developing bias correction mode to increase the thickness of a layer of toner if the image data has a partially high print duty. This alleviates wear of the surface of the developing roller 2, and prevents the nip formed between the developing roller 2 and the photoconductive drum 1 from decreasing. Thus, vague images in a solid image portion and soiling of the print medium 44 may be minimized.

The first embodiment has been described with respect to the power supplies that output negative voltages, the power supplies may also be configured to output positive voltages.

Second Embodiment

In the first embodiment, the developing power supply 24 outputs a lower developing voltage |V1| to the developing roller 2 in the developing bias correction mode, thereby increasing the voltage difference |V3| to a value larger than the normal value so that the thickness of a layer 70 of toner is increased. However, if the image forming apparatus operates in the developing bias correction mode, the density of an image may become low with the changes in environmental conditions. In contrast, an image forming apparatus of a second embodiment operates in a toner supplying bias correction mode where a toner supplying power supply 25 applies a higher voltage |V2| to the toner supplying roller 3 under the control of a controller 19, thereby increasing the voltage difference |V3| to a value larger than the normal value so that the thickness of the layer 70 of toner is increased.

The configuration and operation of the image forming apparatus and developing apparatus of the second embodiment will be described.

Just as in the first embodiment, a data area (printable area) for a print job is divided into n sub data areas m(1), m(2), m(3), . . . , m(i), . . . , m(n) (n is an integer) such that the sub data areas m(1) to m(n) have, for example, a 5-mm width and are aligned in the main scanning direction perpendicular to a direction of travel of the print medium 44. Then, a print duty for each sub data area is computed.

Figure 11:
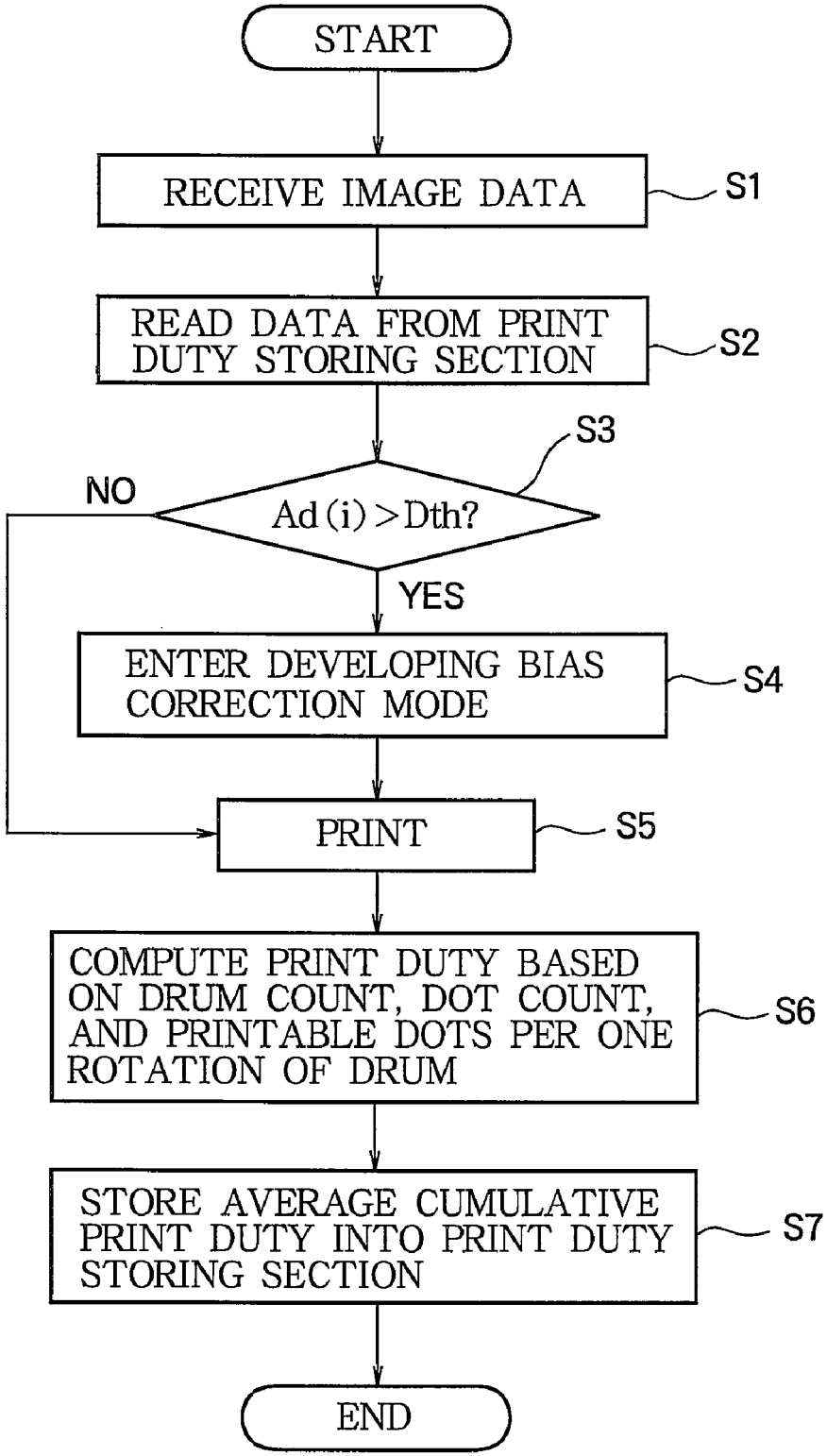
FIG. 11 is a flowchart illustrating the method for determining whether an image pattern has a high print duty.

FIG. 11 is a flowchart illustrating the method for determining whether an image pattern has a high print duty portion. The method will be described in detail with reference to FIG. 11.

At step S1, the receiving memory 15 temporarily holds the image data received through the interface controller 14.

At step S2, the duty comparing section 61 reads average values Ad(1), Ad(2), Ad(3), . . . , Ad(i), . . . , Ad(n) computed by the duty computing sections 54-56 and the threshold value Dth of print duty.

At step S3, the duty comparing section 61 compares each of the average values Ad(1), Ad(2), Ad(3), . . . , Ad(i), . . . , Ad(n) with the threshold value Dth to determine whether the average value is greater than the threshold value Dth (e.g., 40%).

If all of the average values Ad(1), Ad(2), Ad(3), . . . , Ad(i), . . . , Ad(n) are smaller than the threshold value Dth (NO at step S3), the program proceeds to step S5. If any one of the average values Ad(1), Ad(2), Ad(3), . . . , Ad(i), . . . , Ad(n) is larger than the threshold value Dth (YES at step S3), then the program proceeds to step S4.

At step S4, the image forming apparatus enters the toner supplying bias correction mode.

At step S5, printing is performed.

At step S6, a duty computing section 54 computes the print duties for the respective sub data areas m(1), m(2), m(3), . . . , m(i) . . . , m(n) based on the number of printed dots (i.e., count of counter Cm(i)), a total number of printable dots per one complete rotation of the image bearing body (1), and the count of a drum counter 53.

At step S7, a new average value Ad(i), Ad(2), Ad(3), . . . , Ad(i), . . . , Ad(n) of the print duty for each of the sub data areas m(1), m(2), m(3), . . . , m(i) . . . , m(n) is computed based on the print duty of the image data printed at step S5 and the cumulative print duties $$\sum_{J=1}^{J=J} d(1),\quad \sum_{J=1}^{J=J} d(2),\quad \sum_{J=1}^{J=J} d(3),\ \ldots,\quad \sum_{J=1}^{J=J} d(i),\ \ldots,\quad \sum_{J=1}^{J=J} d(n),$$

and is then stored into the duty storing section 57.

Then, printing completes.

As is clear from Eq. 1 (first embodiment), smaller values of voltage difference |V3| cause smaller amounts of toner deposited on the developing roller 2. Larger values of voltage difference |V3| cause larger amounts of toner deposited on the developing roller 2.

Table 2 lists the values of power supply voltages outputted from the respective power supplies and constants A and B when the image forming apparatus operates in the toner supplying bias correction mode.

TABLE 2

| Voltages and constants | With no correction | With correction |
|---|---|---|
| V1 (volts) | −300 | −300 |
| V2 (volts) | −450 | −510 |
| V3 (volts) | −150 | −210 |
| V4 (volts) | −1350 | −1350 |
| V5 (volts) | −1050 | −1050 |
| A | | 0.0033 |
| B | | 0.060 |

|V5| = |V4| − |V1|,
|V3| = |V2| − |V1|,
150 ≦ |V3| ≦ 300

As is clear from Table 2, changing the voltage |V2| from |−450| V to |−510| V causes the voltage difference |V3| to increase from 150 to 210. As a result, the amount of toner h deposited on the developing roller 2 increases from 0.55 mg/cm$^2$ to 0.75 mg/cm$^2$ as shown in FIG. 8.

Figure 12:
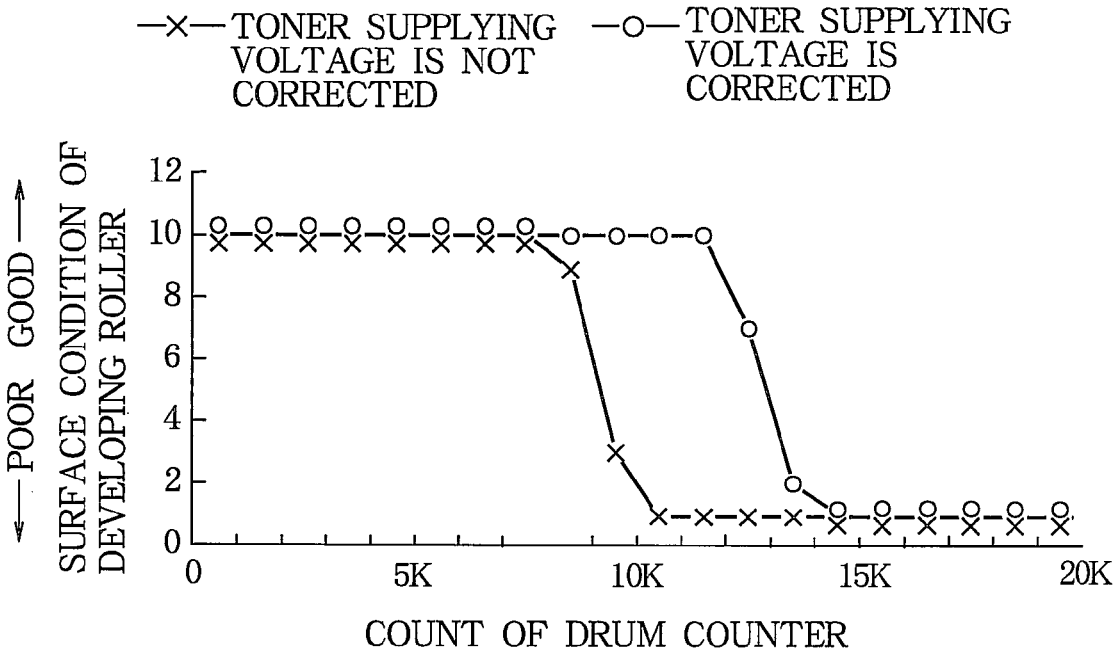
FIG. 12 illustrates changes in the level of wear of the developing roller versus changes in the count of the drum counter.

FIG. 12 illustrates changes in the level of wear of the developing roller 2 versus changes in the count of the drum counter when the image forming apparatus operates in the toner supplying bias correction mode and when the image forming apparatus does not operate in the toner supplying bias correction mode. The lower the value of surface condition is, the more the developer roller 2 is worn out. Printing was performed by using image data (FIG. 4) having a ruled pattern with a print duty of 100%. The lifetime of the developing roller 2 may be longer by a factor of 1.4 when the image forming apparatus operates in the toner supplying bias correction mode than when the image forming apparatus does not operate in the toner supplying bias correction mode.

The results shown in FIG. 12 reveal that the lifetime of the developing roller 2 has been prolonged by approximately 10% despite the fact that the voltage difference |V3| for the second embodiment is the same as that for the first embodiment. This is because the voltage difference |V3| is increased by 60 V and therefore the potential of the triboelectrically charged toner 8 is increased. Thus, the amount of the toner 8 deposited on the developing roller 2 increases as shown by Line B of FIG. 8, so that the thickness of a layer 80 of toner after development of an electrostatic latent image increases to prolong the life time of the developing roller 2.

As described above, the received image data is divided into a plurality of sub image data areas aligned in the main scanning direction. Dots printed in each sub image data area are counted, and the count is compared with a threshold value. Based on the comparison result, an image having a partially high print duty portion is detected and then the toner supplying bias is changed in the toner supplying bias correction mode to increase the thickness of a layer of toner. This alleviates wear of the surface of the developing roller 2, and prevents the nip between the developing roller 2 and the photoconductive drum from decreasing. Thus, vague images in a solid image portion and soiling of the print medium 44 may be minimized.

The image forming apparatus operates in the toner supplying bias correction mode such that the voltage |V2| is increased with the voltage |V1| unchanged, thereby increasing the voltage difference |V3|. Thus, print density is higher when the image forming apparatus operates in the toner supplying bias correction mode than when the image forming apparatus does not operate in the toner supplying bias correction mode.

Although, the second embodiment has been described with respect to power supplies that output negative voltages, the power supplies may also be configured to output positive voltages.

Third Embodiment

A third embodiment is a combination of the first and second embodiments. An image forming apparatus of the third embodiment operates at a higher voltage difference |V3| than the first and second embodiments. As a result, a photoconductive drum 1 receives a larger amount of toner 8 than the photoconductive drum can hold, thereby forming a layer 70 of excessive toner which in turn may cause soiling of the print medium 44. Thus, the third embodiment is configured such that an image forming apparatus operates in a charging bias correction mode where the voltage difference |V3| is larger than those for the first and second embodiments, and a voltage V5 (V5=V4−V1) is increased. The increases in |V3| and |V5| cause increases in the amount of charge on the surface of the photoconductive drum 1. An increase in the amount of charge prevents soiling of the print medium 44.

The description of the configuration and operation of the image forming apparatus and the developing apparatus will be omitted except for the following differences.

The print duty is computed just as in the first embodiment. Referring to FIG. 3, a data area (printable area) for a print job is divided into n sub data areas m(1), m(2), m(3), . . . , m(i), . . . , m(n) (n is an integer) such that the n sub data areas m(1) to m(n) have, for example, a 5 mm-width and are aligned in the main scanning direction perpendicular to a direction of travel of the print medium 44.

A method for determining whether image data contains a high print duty portion will be described. The voltage difference V5 between the charging voltage V4 outputted from the charging power supply 22 and the voltage V1 outputted from the developing power supply 24 is increased for prolonging the lifetime of the developing roller 2.

Figure 13:
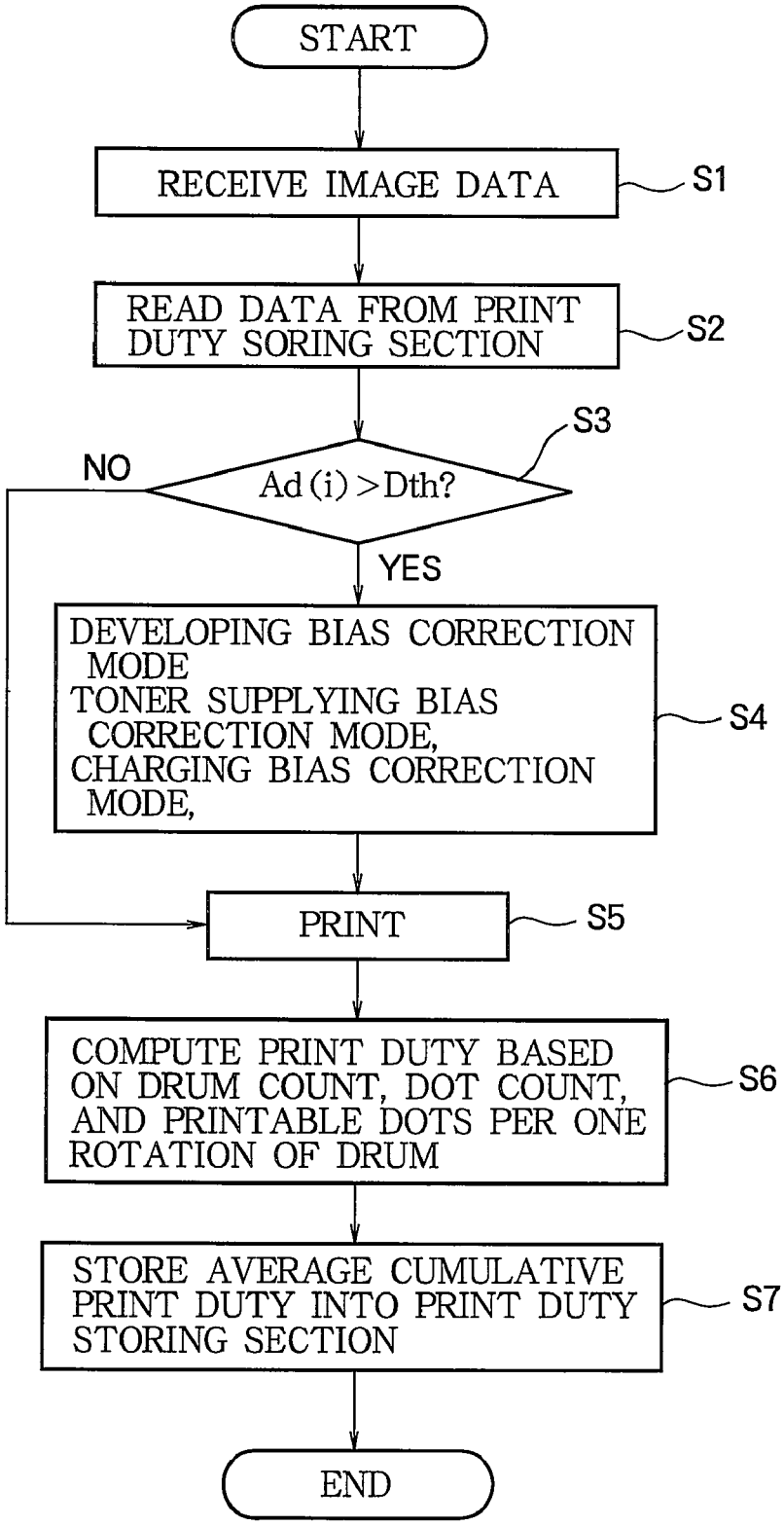
FIG. 13 is a flowchart illustrating how image data containing a high print duty portion is detected.

FIG. 13 is a flowchart illustrating how image data containing a high print duty portion is detected. The developing voltage V1, and the charging voltage V4 are of the same polarity and the absolute value of the developing voltage V1 is greater than that of charging voltage V4, i.e., |V1|≦|V4|.

At step S1, the receiving memory 15 temporarily holds the image data received through the interface controller 14.

At step S2, a duty comparing section 61 reads cumulative print duties $$\sum_{J=1}^{J=J} d(1), \sum_{J=1}^{J=J} d(2), \sum_{J=1}^{J=J} d(3), \ldots, \sum_{J=1}^{J=J} d(i), \ldots, \sum_{J=1}^{J=J} d(n),$$

computed by the duty computing sections 54-56 and the threshold value Dth of print duty.

At step S3, the duty comparing section 61 compares the average value with the threshold value Dth to determine whether the average value is greater than the threshold value Dth (e.g., 40%).

If all of the average values Ad(1), Ad(2), Ad(3), . . . , Ad(i), . . . , Ad(n) are smaller than the threshold value Dth (NO at step S3), the program proceeds to step S6. If any one of the average values Ad(1), Ad(2), Ad(3), . . . , Ad(i), . . . , Ad(n) is larger than the threshold value Dth (YES at step S3), the program proceeds to step S4.

At step S4, the image forming apparatus enters the developing bias correction mode, the toner supplying bias correction mode, and the charging bias correction mode, simultaneously. Then the program proceeds to step S5.

At step S5, printing is performed.

At step S6, the duty computing section 54 computes the print duty for each of the respective sub data areas m(1), m(2), m(3), . . . , m(i) . . . , m(n) of the image data printed at step S5 based on the number of printed dots (i.e., counts of counters Cm(1), Cm(2), Cm(3), . . . , Cm(i) . . . , Cm(n)), a total number of printable dots per one complete rotation of the image bearing body (1), and the count of the drum counter 54.

At step S7, a new average value Ad(i) of the print duty for each of the sub data areas m(1), m(2), m(3), . . . , m(i) . . . , m(n) is computed based on the print duty of the image data printed at step S5 and the cumulative print duties $$\sum_{J=1}^{J=J} d(1), \sum_{J=1}^{J=J} d(2), \sum_{J=1}^{J=J} d(3), \ldots, \sum_{J=1}^{J=J} d(i), \ldots, \sum_{J=1}^{J=J} d(n),$$

and is then stored into the duty storing section 57. Then, the new average value is then stored into the duty storing section 57.

Then, printing completes.

As is clear from Eq. (1), smaller values of voltage difference |V3| cause smaller amounts of toner deposited on the developing roller 2. Larger values of voltage difference |V3| cause larger amounts of toner deposited on the developing roller 2.

In the third embodiment, the developing bias correction mode is entered to control the developing power supply 24 such that the developing voltage V1 is decreased from |−300| V to |−240| V. Then, the toner supplying bias correction mode is entered to control the toner supplying power supply 25 such that the toner supplying voltage V2 is increased from |−450| V to |−510| V, thereby increasing the thickness of the layer 70 of toner formed on the developing roller 2.

Table 3 lists the power supply voltages in the developing bias correction mode, the toner supplying bias correction mode, and the charging bias correction mode. In the third embodiment, the voltage V1 is corrected from |−300| V to |−240| V in the developing bias mode. The voltage V2 is corrected from |−450| V to |−510| V in the toner supplying bias mode. Thus, the voltage difference V3 is increased from 150 V to 270 V.

TABLE 3

| Voltages and constants | With no correction | With correction |
|---|---|---|
| V1 (volts) | −300 | −240 |
| V2 (volts) | −450 | −510 |
| V3 (volts) | −150 | −270 |
| V4 (volts) | −1350 | −1450 |
| V5 (volts) | −1050 | −1210 |
| A | | 0.0045 |
| B | | 0.971 |

$|V5| = |V4| - |V1|$,
$|V3| = |V2| - |V1|$,
$150 \leqq |V3| \leqq 300$

Then, the charging bias correction mode is entered in which the voltage V4 is increased from |−1350| V to |−1450| V, thereby increasing the voltage difference V5. In this manner, the voltage difference V5 is increased to prevent soiling of the developing roller 2 due to excessive toner 8 deposited in the form of the layer 70. As a result, the amount of toner h deposited on the developing roller 2 increases from 0.55 mg/cm$^2$ to 1.09 mg/cm$^2$.

Figure 14:
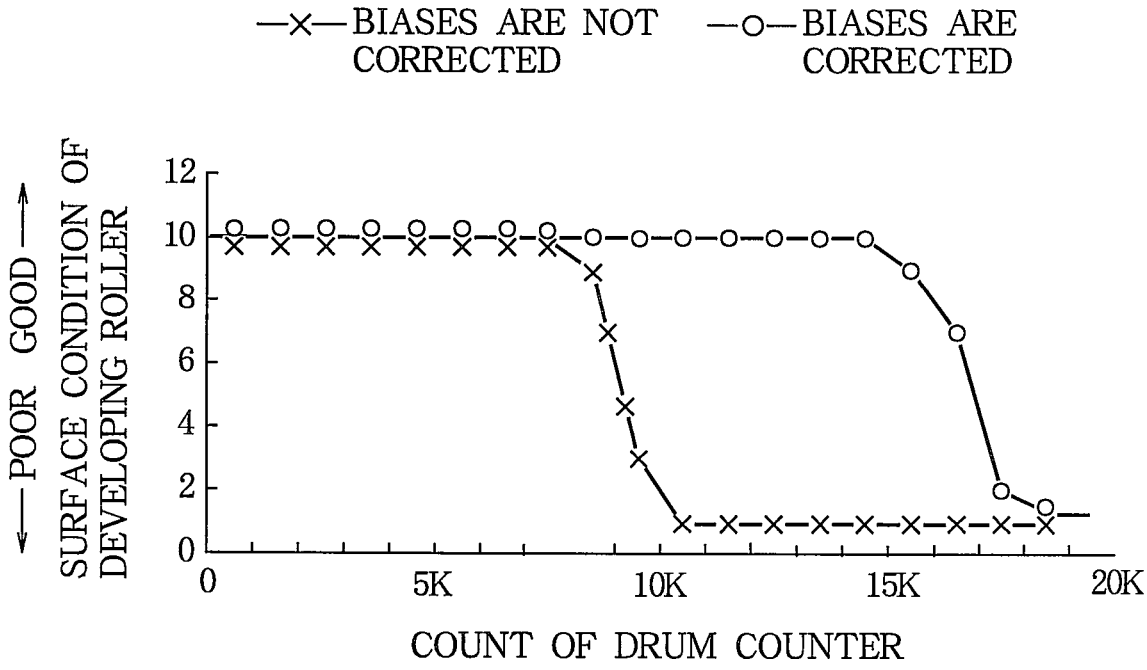
FIG. 14 illustrates changes in the level of wear of the developing roller versus changes in the count of the drum counter.

FIG. 14 illustrates changes in the level of wear of the developing roller 2 versus changes in the count of the drum counter when the image forming apparatus operates in the charging bias correction mode and when the image forming apparatus does not operate in the charging bias correction mode. The lower the value of surface condition is, the more the developing roller 2 is worn out. Printing was performed by using an image data having a ruled pattern (e.g., 5-mm width) of a print duty of 100% as shown in FIG. 4. The lifetime of the developing roller 2 may be longer by a factor of 1.9 when the image forming apparatus operates in the charging bias correction mode than when the image forming apparatus does not operate in the charging bias correction mode.

It is to be noted that the results shown in FIG. 14 provide improvement over the results shown in FIG. 12 (second embodiment) by a factor of almost 2. This is because simultaneous correction is performed both in the developing bias correction mode and in the toner supplying bias correction mode to increase the voltage difference V3 from |−210| V to |−270| V so that the toner is triboelectrically charged to a higher potential. As a result, the amount of toner h deposited to the developing roller 2 as shown by line A of FIG. 8. Thus, this increases the thickness of the layer of toner 80, decreasing wear of the developing roller and prolonging the lifetime of the developing roller 2.

As described above, the received image data is divided into a plurality of sub image data areas in the main scanning direction. Printed dots in each sub image data area are counted, and the count is compared with a threshold value. Based on the comparison result, an image having a high print duty portion is detected and then the toner supplying bias is changed in the toner supplying bias correction mode to increase the thickness of a layer of toner. This alleviates wear of the surface of the developing roller 2 and prevents the nip between the developing roller 2 and the photoconductive drum from decreasing. Thus, vague images in a solid image portion and soiling of the print medium 44 may be minimized.

Controlling the charging voltage V4 in the charging bias correction mode increases the thickness of the layer 80 of the toner, thereby providing the lifetime of the developing roller 2 as well as preventing soiling of the developing roller 2.

The third embodiment has been described with respect to power supplies that output negative voltages, the power supplies may also be configured to output positive voltages.

Fourth Embodiment

In the first to third embodiments, a check is made based on the content of a duty storing section 57, which is the cumulative print duty shortly after the previous printing operation, to determine whether an image forming apparatus should enter the respective correction modes. This method suffers from a problem in that when a print job is of a large size (i.e., great many pages) and has a high print duty portion, the print duty of the job may exceed a threshold Dth=40% but it is difficult to handle such a case properly. A fourth embodiment assumes the following conditions.

(1) The print duty of each one of sub data areas of a print job to be printed is added to a corresponding cumulative print duty for all of the print jobs printed in the past, and then an average value of the cumulative print duty including the print job to be printed is computed for each one of sub data areas.

(2) The image forming apparatus operates based on the computed average cumulative print duties in the three bias correction modes: a developing bias correction mode, a toner supplying bias correction mode, and a charging bias correction mode.

The configuration and operation of the image forming apparatus and developing apparatus of the fourth embodiment are substantially the same as those of the third embodiment. The description of the fourth embodiment will be omitted except for the following differences. Just as in the third embodiment, the image forming apparatus is adapted to operate in the developing bias correction mode, the toner supplying bias correction mode, and the charging bias correction mode.

Figure 15:
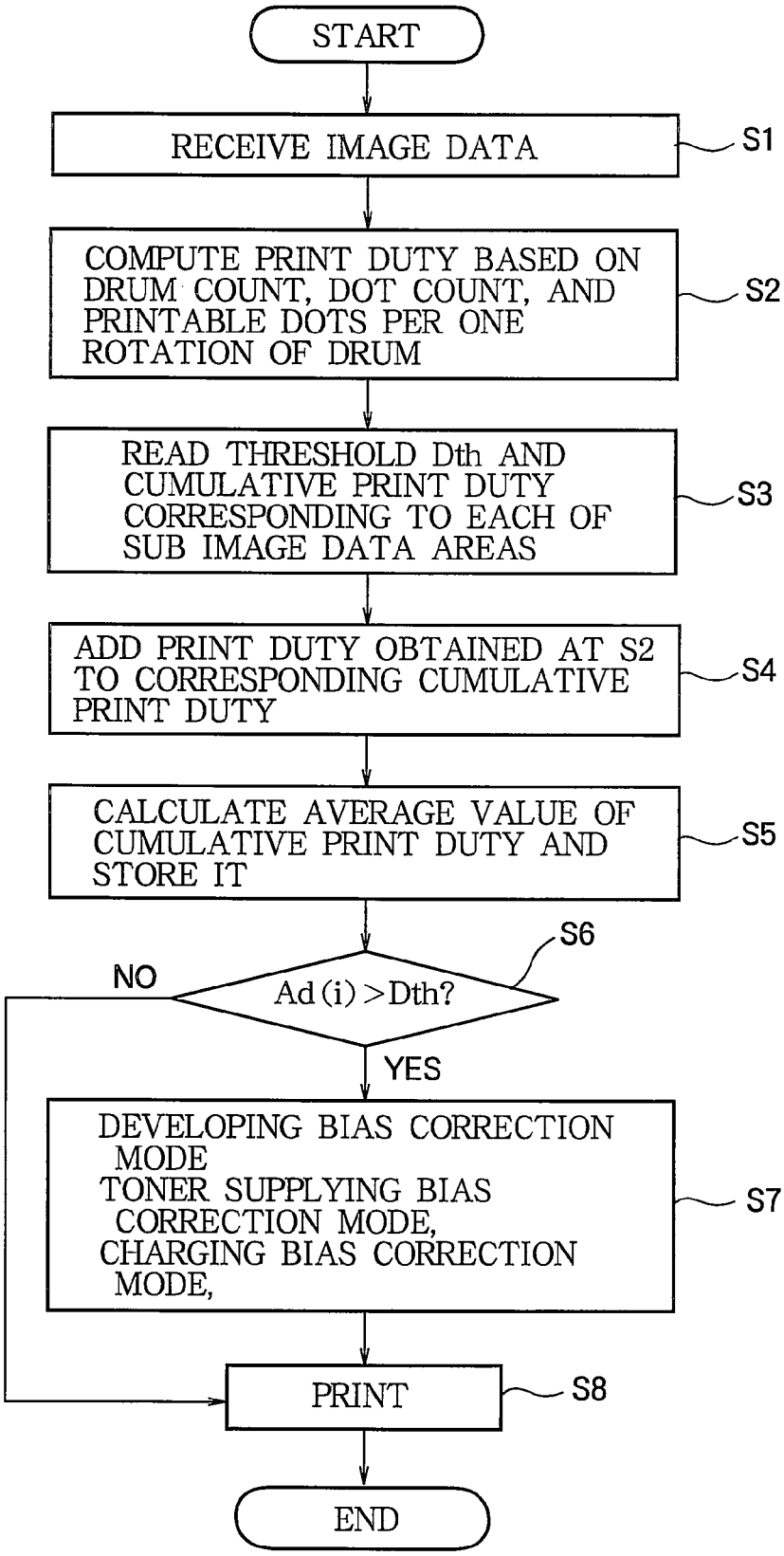
FIG. 15 is a flowchart illustrating how image data containing a high print duty portion is detected based on the print duties of the respective sub image data areas.

FIG. 15 is a flowchart illustrating how image data containing a high print duty portion is detected based on the print duties of the respective sub image data areas.

At step S1, the receiving memory 15 temporarily holds the image data for a print job received through the interface controller 14.

At step S2, the duty computing section 54 computes the print duties for each of the respective sub data areas m(1), m(2), m(3), . . . , m(i) . . . , m(n) based on the number of printed dots (i.e., counts of counters Cm(1), Cm(2), Cm(3), . . . , Cm(i) . . . , Cm(n)) of the printed sub image data, a total number of printable dots per one complete rotation of the image bearing body (1), and the count of the drum counter 54.

At step S3, the duty comparing section 61 reads a predetermined threshold Dth and cumulative print duties $$\sum_{J=1}^{J=I} d(1),\ \sum_{J=1}^{J=I} d(2),\ \sum_{J=1}^{J=I} d(3), \ldots,\ \sum_{J=1}^{J=I} d(i), \ldots,\ \sum_{J=1}^{J=I} d(n),$$

corresponding to sub image data areas m(1), m(2), m(3), . . . , m(i), . . . , m(n) from the duty storing section 57.

At step S4, the duty computing sections 54-56 add the print duties for the respective sub image data areas computed at step S2 to corresponding cumulative print duties $$\sum_{J=1}^{J=J} d(1),\quad \sum_{J=1}^{J=J} d(2),\quad \sum_{J=1}^{J=J} d(3),\ \ldots,\quad \sum_{J=1}^{J=J} d(i),\ \ldots,\quad \sum_{J=1}^{J=J} d(n).$$

At step S5, an average value of cumulative print duty for each of sub image data areas is calculated and is then stored into the duty storing section 57.

At step S6, a check is made to determine whether the average values Ad(1), Ad(2), Ad(3), . . . Ad(i), . . . , Ad(n) are larger than the threshold Dth. If all of the average values Ad(1), Ad(2), Ad(3), . . . Ad(i), . . . , Ad(n) are smaller than the threshold value Dth (NO at step S6, the program proceeds to step S8. If any one of the average values of the average values Ad(1), Ad(2), Ad(3), . . . Ad(i), . . . , Ad(n) is larger than the threshold value Dth (YES at step S4), the program proceeds to step S7.

At step S7, the image forming apparatus enters the developing bias correction mode, the toner supplying bias correction mode, and the charging bias correction mode, and then the program proceeds to step S8.

At step S8 printing is performed.

As described above, the print duty for each of the sub data areas m(1), m(2), m(3), . . . , m(i) . . . , m(n) of a print job is computed before the print job is printed. Then, the computed print duty is added to the corresponding cumulative print duty held in the duty storing section 57, thereby estimating a cumulative print duty including the print job to be printed before the print job is printed. If the estimated cumulative print duty exceeds the threshold Dth, the image forming apparatus enters the respective correction modes. This method of estimating average values of cumulative print duties prior to printing of a print job allows the image forming apparatus to enter the respective correction modes irrespective of the size of a print job to be printed, thereby minimizing wear of the developing roller 2.

The image forming apparatuses of the first to fourth embodiments are applicable not only to electrophotographic printers but also to many other electrophotographic image forming apparatuses including multi function printers, facsimile machines, and copying machines.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus that performs printing image data of a print job received from a host apparatus on a print medium, the image forming apparatus comprising:

an image bearing body on which an electrostatic latent image is formed;

a charging member that charges the image bearing body;

a developer material bearing body that supplies a developer material to the electrostatic latent image to form a developer image;

a developer material supplying member that supplies the developer material to the developer material bearing body;

a first power supply that applies a first voltage to the developer material bearing body;

a second power supply that applies a second voltage to the developer material supplying member;

a third power supply that applies a third voltage to the charging member;

a dividing section that divides the image data into a plurality of sub data areas, each of the sub data areas extending from the beginning of the entire image data to the end of the entire image data;

a dot counter that counts a number of dots in a corresponding one of the plurality of sub data areas;

a computing section that computes a print duty for each of the plurality of sub data areas based on the number of dots counted by the dot counter and a total number of printable dots in a printable area for the print job, a total number of print duties in the print job being equal in number to the plurality of sub data areas;

a memory that holds a reference and the print duty;

a comparing section that compares the print duty with the reference; and a controller that controls the second power supply to increase a voltage difference between the first voltage and the second voltage while maintaining the third voltage and the first voltage, the voltage difference being increased when the print duty is larger than the reference.

2. The image forming apparatus according to claim 1, further comprising a drum counter that counts a number of rotations of the image bearing body, wherein the total number of printable dots in a printable area is computed based on the number of rotations and a number of printable dots per one complete rotation of the image bearing body.

3. An image forming apparatus that performs printing image data of a print job received from a host apparatus on a print medium, the image forming apparatus comprising;

an image bearing body on which an electrostatic latent image is formed;

a charging member that charges the image bearing body;

a developer material bearing body that supplies a developer material to the electrostatic latent image to form a developer image;

a developer material supplying member that supplies the developer material to the developer material bearing body;

a first power supply that applies a first voltage to the developer material bearing body;

a second power supply that applies a second voltage to the developer material supplying member;

a third power supply that applies a third voltage to the charging member;

a dividing section that divides the image data into a plurality of sub data areas;

a dot counter that counts a number of dots in a corresponding one of the plurality of sub data areas;

a computing section that computes a print duty for each of the plurality of sub data areas based on the number of dots counted by the dot counter and a total number of printable dots in a printable area;

a memory that holds a reference and the print duty;

a comparing section that compares the print duty with the reference; and a controller that controls the first and second power supplies to increase a first voltage difference between the first voltage and the second voltage while maintaining the third voltage and the first voltage, the voltage difference being increased when the print duty is larger than the reference and controls the third power supply to increase a second voltage difference between the first voltage and the third voltage when the print duty is larger than the reference.

4. The image forming apparatus according to claim 1, wherein the computing section computes the print duty after the image data has been printed on the print medium;

the memory holds an average value of a cumulative print duty for each of the plurality of sub data areas after the image data has been printed; and the comparing section compares the average value with the reference;

wherein when the average value is larger than the reference, the controller controls the second power supply to increase the first voltage difference.

5. The image forming apparatus according to claim 1 further comprising a drum counter that counts a number of rotations of the image bearing body, wherein the print duty is given by $$d(i)=(Cm(i))/(C0\times Cd)$$

where d(i) is the print duty for an i-th sub data area, Cm(i) is a count of the dot counter for the i-th sub data area, C0 is a total number of printable dots per one complete rotation of the image bearing body, and Cd is a count of the drum counter.

6. The image forming apparatus according to claim 5, wherein an average value of a cumulative print duty is determined for each of the plurality of sub data areas after the image data has been printed, the average value being given by $$Ad(i) = \frac{\sum_{J=1}^{J=J} d(i)}{J}$$

where $$\sum_{J=1}^{J=J} d(i)$$

is the cumulative print duty for sub data area,

J is the total number of print jobs, and Ad(i) is the average value of the cumulative print duty for each sub data area, wherein when the average value is larger than the reference, the second voltage is changed to increase the voltage difference.

7. The image forming apparatus according to claim 3 further comprising a drum counter that counts a number of rotations of the image bearing body, wherein the print duty is given by $$d(i)=(Cm(i))/(C0\times Cd)$$

where d(i) is the print duty for an i-th sub data area, Cm(i) is a count of the dot counter for the i-th sub data area, C0 is a total number of printable dots per one complete rotation of the image bearing body, and Cd is a count of the drum counter.

8. The image forming apparatus according to claim 7, wherein an average value of a cumulative print duty is determined for each of the plurality of sub data areas after the image data has been printed, the average value being given by $$Ad(i) = \frac{\sum_{J=1}^{J=J} d(i)}{J}$$

where $$\sum_{J=1}^{J=J} d(i)$$

is the cumulative print duty for sub data area,

J is the total number of print jobs, and Ad(i) is the average value of the cumulative print duty for sub data area, wherein when the average value is larger than the reference, the second voltage is changed to increase the voltage difference.

9. The image forming apparatus according to claim 3, wherein when the print duty is larger than the reference, the controller controls the first power supply to decrease the first voltage.

10. The image forming apparatus according to claim 3, wherein when the print duty is larger than the reference, the controller controls the second power supply to increase the second voltage.

11. The image forming apparatus according to claim 3, wherein the computing section computes the print duty after the image data has been printed on the print medium;

the memory holds an average value of a cumulative print duty for each of the plurality of sub data areas after the image data has been printed; and the comparing section compares the average value with the reference;

wherein when the average value is larger than the reference, the controller controls the first and second power supplies to increase the first voltage difference.

12. The image forming apparatus according to claim 3, wherein the computing section computes the print duty before the image data is printed;

the memory holds an average value of a cumulative print duty for each of the plurality of sub data areas before the image data is printed so that the average value reflects the print duty of the image data of a print job to be printed; and the comparing section compares the average value with the reference;

wherein when the average value is larger than the reference, the controller controls the first and second power supplies to increase the first voltage difference and the third power supply to increase the second voltage difference.

13. An image forming apparatus that performs printing of image data of a print job received from a host apparatus on a print medium, the image forming apparatus comprising:

an image hearing body on which an electrostatic latent image is formed;

a charging member that charges the image bearing body;

a developer material bearing body that supplies a developer material to the electrostatic latent image to form a developer image;

a developer material supplying member that supplies the developer material to the developer material bearing body;

a first power supply that applies a first voltage to the developer material bearing body;

a second power supply that applies a second voltage to the developer material supplying member;

a third power supply that applies a third voltage to the charging member;

a dividing section that divides the entire image data for a print job into a plurality of sub data areas, each of the sub data areas extending from the beginning of the entire image data to the end of the entire image data;

a dot counter that counts a number of dots in a corresponding one of the plurality of sub data areas;

a computing section that computes a print duty for each of the plurality of sub data areas based on the number of dots counted by the dot counter and a total number of printable dots in a total printable area for the print job, a total number of print duties in the print job being equal in number to the plurality of sub data areas;

a memory that holds a reference and the print duty;

a comparing section that compares the print duty with the reference; and a controller that controls the first and second power supplies to increase a first voltage difference between the first voltage and the second voltage while maintaining the first voltage and the third voltage, the voltage difference being increased when the print duty is larger than the reference, and controls the third power supply to increase a second voltage difference between the first voltage and the third voltage when the print duty is larger than the reference.

* * * * *